US008791635B2

(12) United States Patent
Yasuda et al.

(10) Patent No.: US 8,791,635 B2
(45) Date of Patent: Jul. 29, 2014

(54) SHORT ARC DISCHARGE LAMP

(71) Applicant: Ushio Denki Kabushiki Kaisha, Tokyo (JP)

(72) Inventors: Yukio Yasuda, Himeji (JP); Akiko Uchino, Himeji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/896,647

(22) Filed: May 17, 2013

(65) Prior Publication Data

US 2013/0313970 A1 Nov. 28, 2013

(30) Foreign Application Priority Data

May 23, 2012 (JP) ..... 2012-117198

(51) Int. Cl.
*H01J 17/06* (2006.01)
*H01J 61/06* (2006.01)
*H01J 9/02* (2006.01)

(52) U.S. Cl.
CPC ..... *H01J 61/06* (2013.01)
USPC ..... 313/632; 313/633

(58) Field of Classification Search
CPC ..... H01J 61/06; H01J 61/073–61/0737
USPC ..... 313/311, 632, 633
See application file for complete search history.

(56) References Cited

U.S. PATENT DOCUMENTS

2011/0181181 A1 7/2011 Shimizu et al. ..... 313/638
2012/0001541 A1 1/2012 Ikeuchi et al. ..... 313/632

FOREIGN PATENT DOCUMENTS

JP 2011-154927 A 8/2011
JP 2012-015007 A 1/2012

*Primary Examiner* — Nimeshkumar Patel
*Assistant Examiner* — Steven Horikoshi
(74) *Attorney, Agent, or Firm* — Fitzpatrick, Cella, Harper & Scinto

(57) ABSTRACT

Disclosed herein is a short arc discharge lamp which has a cathode electrode structure formed by solid-phase bonding a tip part made of thoriated tungsten to a body part made of tungsten. According to the present invention, the bonding strength between the body part and the tip part is increased to the same level as the mechanical strength of tungsten, thus preventing a breakage from being caused on a junction interface. For this, on a section of the cathode electrode taken along a line perpendicular to the junction interface, in an arbitrary portion of 500 μm or more in length along the junction interface, when a length of the arbitrary portion along the junction interface is set to $L_0$, and a sum of lengths of tungsten crystal grains, along the junction interface, that are present through the junction interface is set to L, (L/L0) ≥0.16 is satisfied.

1 Claim, 8 Drawing Sheets

| No | bonding rate (μm/μm) | tensile strength (MPa) | breakage or not when cutting |
|---|---|---|---|
| 1 | 0. 13 | 180 (junction interface) | × |
| 2 | 0. 16 | 216 (excluding junction interface) | ○ |
| 3 | 0. 28 | 294 (excluding junction interface) | ○ |
| 4 | 0. 70 | 307 (excluding junction interface) | ○ |
| 5 | 0. 96 | 300 (excluding junction interface) | ○ |
| | | | × : breakage |
| | | | ○ : no breakage |

FIG. 7

SHORT ARC DISCHARGE LAMP

CROSS REFERENCE TO RELATED APPLICATION

This application claims the benefit of Japanese Patent Application No. 2012-117198, filed on May 23, 2012, which is hereby incorporated by reference in its entirety into this application.

BACKGROUND OF THE INVENTION

1. Technical Field

The present invention relates generally to short arc discharge lamps and, more particularly, to a short arc discharge lamp in which a cathode electrode is provided with a tip part containing thorium oxide.

2. Description of the Related Art

Generally, conventional short arc discharge lamps filled with mercury come near to a point light source and a distance between front ends of a pair of electrodes that are disposed opposite to each other is comparatively short. Therefore, such a short arc discharge lamp filled with mercury is combined with an optical system and thus mainly used as a light source of exposure equipment that has high light collection efficiency.

Short arc discharge lamps filled with xenon are used as visible ray sources for projectors or the like, and they are currently widely used as light sources for digital cinema.

In such short arc discharge lamps, a cathode electrode may contain an emitter material such as thorium oxide so that electron emission characteristics can be improved.

However, if the cathode electrode is configured such that the entirety thereof contains thorium oxide as an emitter material, the consumption of thorium oxide is increased. This is not preferable in terms of reduction of material usage. Furthermore, because thorium is a radioactive material, there are many regulations with regard to handling it. Therefore, it is substantially difficult to realize a cathode electrode wherein the entire body contains thorium oxide as emitter material.

Given this, as a method of manufacturing a cathode electrode that contains thorium oxide as emitter material, a technique in which a body part of the cathode electrode is made of tungsten and a tip part made of thoriated tungsten containing thorium oxide is solid-phase bonded to a front end of the body part was introduced. A representative example of a cathode electrode produced by the technique was proposed in Japanese Patent Laid-open Publication No. 2012-015007 (Patent document 1).

However, in this conventional technique of manufacturing a cathode electrode having a solid-phase bonding structure, after the tip part made of thoriated tungsten has been solid-phase bonded to the body part that is made of tungsten, when it is machined into a predetermined shape by cutting using a lathe or the like, the cathode electrode may be broken at a junction interface between the body part and the tip part by impact generated during the cutting process.

As such, the conventional technique is problematic in that the bonding strength of the cathode electrode on the junction interface is comparatively low, whereby mechanical fracture may occur from the junction interface.

Prior Art Document

Patent Document

Japanese Patent Laid-open Publication No. 2012-015007

SUMMARY OF THE INVENTION

Accordingly, the present invention has been made keeping in mind the above problems occurring in the prior art, and an object of the present invention is to provide a short arc discharge lamp which has a cathode electrode structure formed by solid-phase bonding a tip part made of thoriated tungsten to a body part made of tungsten, wherein the cathode electrode structure is configured such that the bonding strength between the body part and the tip part of the cathode electrode is increased to the same level as the mechanical strength of tungsten that is a parent material of the body part, thus preventing separation or breakage from occurring at the junction interface between the body part and the tip part when the cathode electrode is machined by cutting.

In order to accomplish the above object, the present invention provides a short arc discharge lamp, including: a light emitting tube; and a cathode electrode and an anode electrode disposed opposite to each other in the light emitting tube, the cathode electrode comprising a body part made of tungsten and a tip part made of thoriated tungsten, the body part and the tip part being solid-phase bonded to each other, wherein, on a section of the cathode electrode taken along a line perpendicular to a junction interface between the body part and the tip part, in an arbitrary portion of 500 μm or more in length along the junction interface, when a length of the arbitrary portion along the junction interface is set to L0, and a sum of lengths of tungsten crystal grains, along the junction interface, that are present through the junction interface is set to L, $(L/L0) \geq 0.16$ is satisfied.

In a cathode electrode according to the present invention in which a tip part containing thorium oxide is solid-phase bonded to a body part made of tungsten, a ratio of the sum of lengths or areas of tungsten crystal grains, which are present through a junction interface between the body part and the tip part, to the length or area of the junction interface is above a predetermined value so that the mechanical strength on the junction interface can be markedly enhanced, thus preventing the tip part from being removed from the body part or being damaged when the cathode electrode is machined by cutting.

BRIEF DESCRIPTION OF THE DRAWINGS

The above and other objects, features and advantages of the present invention will be more clearly understood from the following detailed description taken in conjunction with the accompanying drawings, in which:

FIG. 7 is a table showing the effects of the present invention; and

DESCRIPTION OF THE PREFERRED EMBODIMENTS

Figure 1:
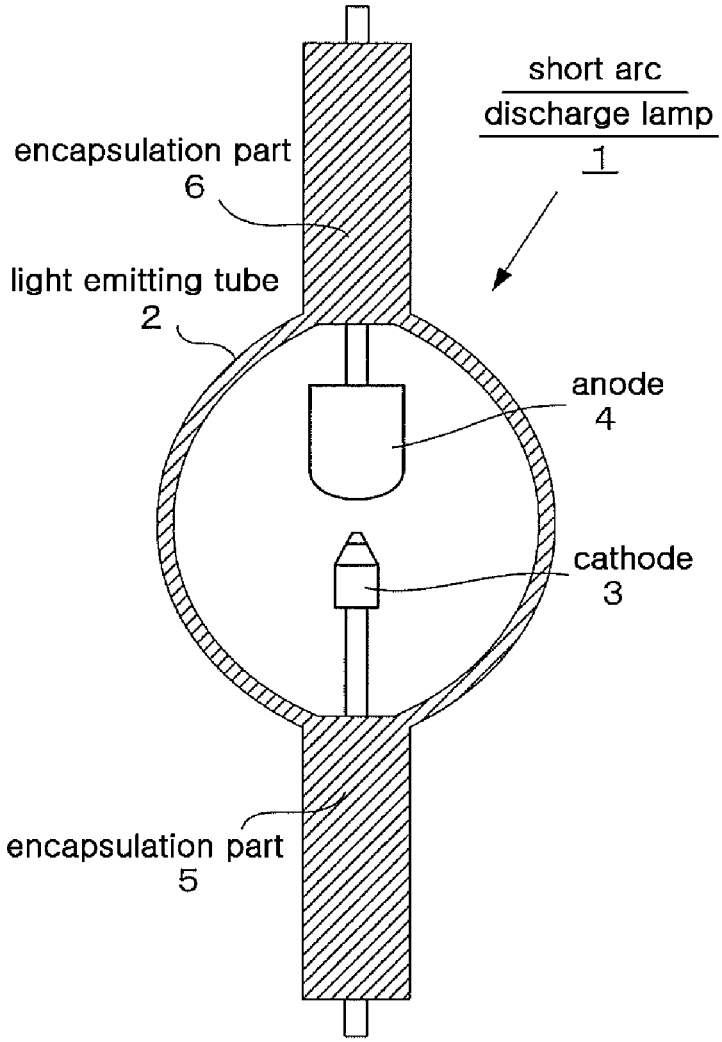
FIG. 1 is a sectional view of a discharge lamp, according to the present invention.

Reference now should be made to the drawings, throughout which the same reference numerals are used to designate the same or similar components.

FIG. 1 illustrates a short art discharge lamp 1 according to the present invention. As shown in the drawing, a cathode electrode 3 and an anode electrode 4 are disposed opposite to each other in a light emitting tube 2 made of quartz glass. Both electrodes 3 and 4 are respectively encapsulated and supported by encapsulation parts 5 and 6.

Figure 2:
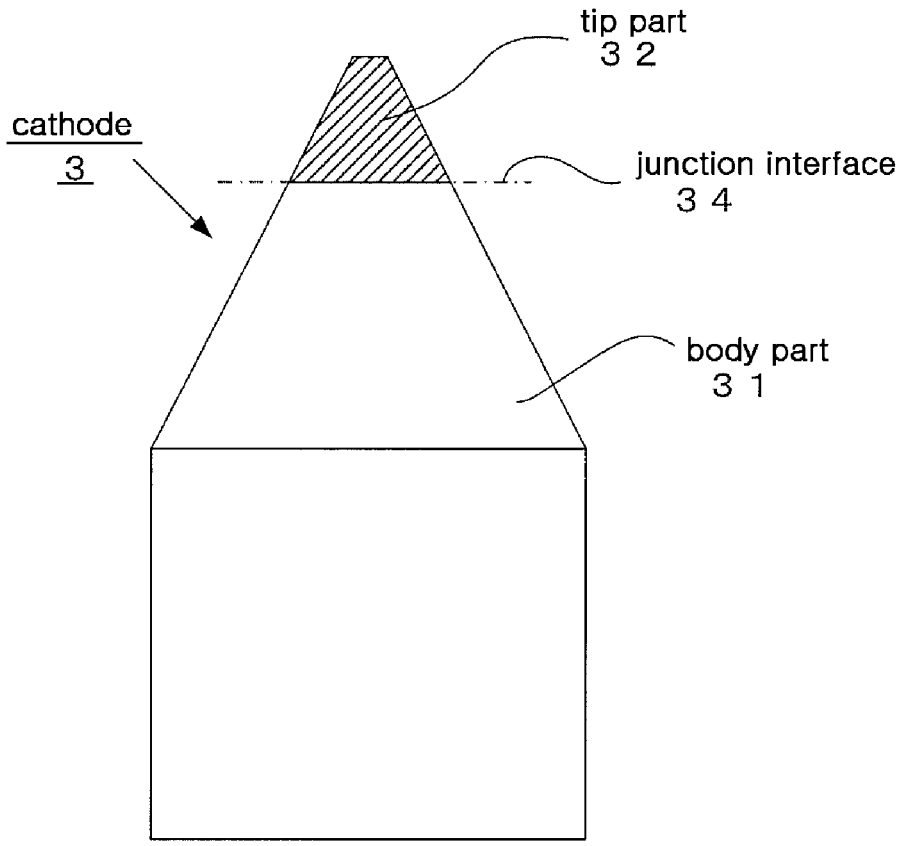
FIG. 2 is an enlarged view illustrating a cathode electrode according to the present invention.

FIG. 2 illustrates the structure of the cathode electrode 3. The cathode electrode 3 includes a body part 31 which is made of tungsten, and a tip part 32 which is bonded to a front end of the body part 31 by solid-phase diffusion bonding. The term "solid-phase diffusion bonding" refers to that metal substances come into surface contact with each other, and heat and pressure are applied to them in a solid-phase state under the melting point not to be plastically deformed, so that atoms in the junction therebetween are diffused and they are bonded in solid phase.

The tip part 32 is made of thoriated tungsten which contains tungsten, as a main component, and thorium oxide ($ThO_2$) as an emitter material. The thorium oxide content of the tip part 32 is, for example, 2 wt %.

The tip part 32, along with the body part 31, generally has a tapered shape. As shown in FIG. 1, the tip part 32 is oriented such that a front end thereof faces the anode electrode 4.

While the lamp is being turned on, the thorium oxide that is contained in thoriated tungsten constituting the tip part 32 is heated and thus reduced so that it becomes thorium atoms. The thorium atoms are diffused onto the outer surface of the tip part 32 and moved towards the front end thereof that is comparatively high in temperature. Thereby, a work function is reduced, whereby electron emission characteristics are improved.

Figure 3:
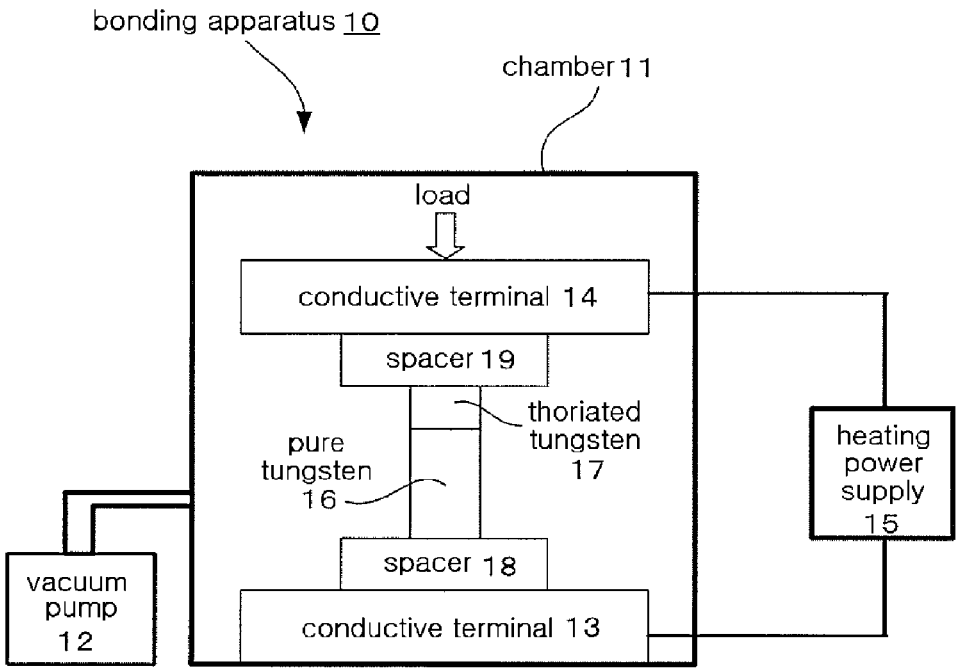
FIG. 3 illustrates a method of manufacturing the cathode electrode according to the present invention.

FIG. 3 illustrates a bonding apparatus 10 for the cathode electrode having such a solid-phase bonding structure. The bonding apparatus 10 includes a vacuum chamber 11 which is maintained in a vacuum state by a vacuum pump 12. A pair of conductive terminals 13 and 14 are installed in the vacuum chamber 11 and are connected to a heating power supply 15 which is provided outside the vacuum chamber 11.

A pure tungsten member 16 which forms the body part and a thoriated tungsten member 17 which forms the tip part are disposed between the conductive terminals 13 and 14 such that surfaces of them to be bonded to each other come into surface contact with each other. Here, the pure tungsten member 16 and the thoriated tungsten member 17 that are members to be bonded to each other are interposed and supported between the conductive terminals 13 and 14 by spacers 18 and 19 that are made of a conductive material such as carbon. The spacers 18 and 19 function as separators which facilitate separation of the pure tungsten member 16 and the thoriated tungsten member 17 from the conductive terminals 13 and 14 after the bonding process has been completed.

As such, the pure tungsten member 16 and the thoriated tungsten member 17 that are interposed and supported between the conductive terminals 13 and 14 are pressurized by the conductive terminals 13 and 14 with a predetermined pressure and heated at a predetermined temperature so that they are diffusion-bonded to each other.

An example of conditions of the bonding process using the bonding apparatus having the above-mentioned construction is as follows.

heating temperature: a temperature range equal to or higher than ⅓ of the absolute temperature of the melting point of metal (tungsten) to be bonded, in detail, 1,900° C.

pressurized load: 30 MPa duration of power application: 200 sec

According to the above-mentioned bonding process, the pure tungsten member 16 which forms the body part 31 and the thoriated tungsten member 17 which forms the tip part 32 of the cathode electrode 3 can be bonded, on the junction therebetween, to each other in a solid phase.

Figure 4A:
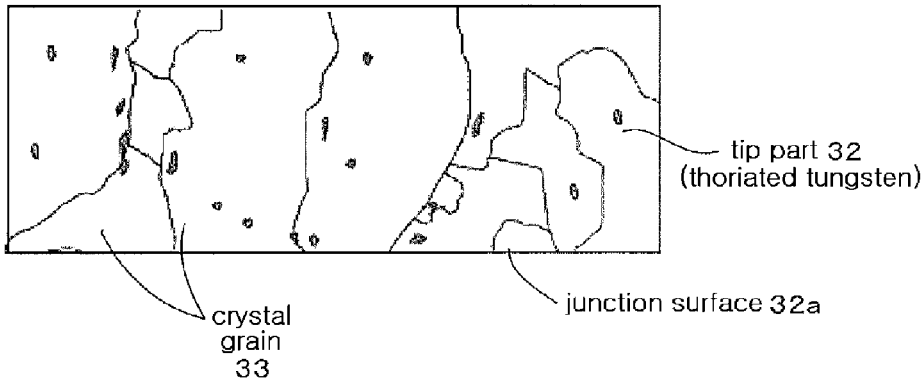
FIGS. 4A and 4B are enlarged sectional views illustrating the cathode electrode that is not in a bonded state according to the present invention.
Figure 4B:
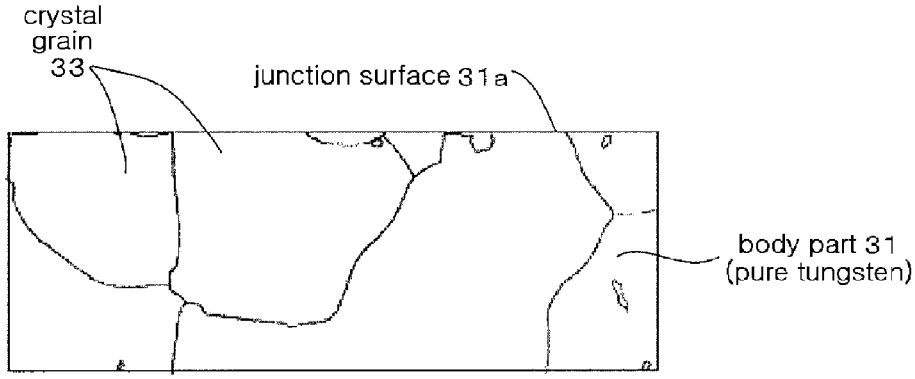
Figure 5:
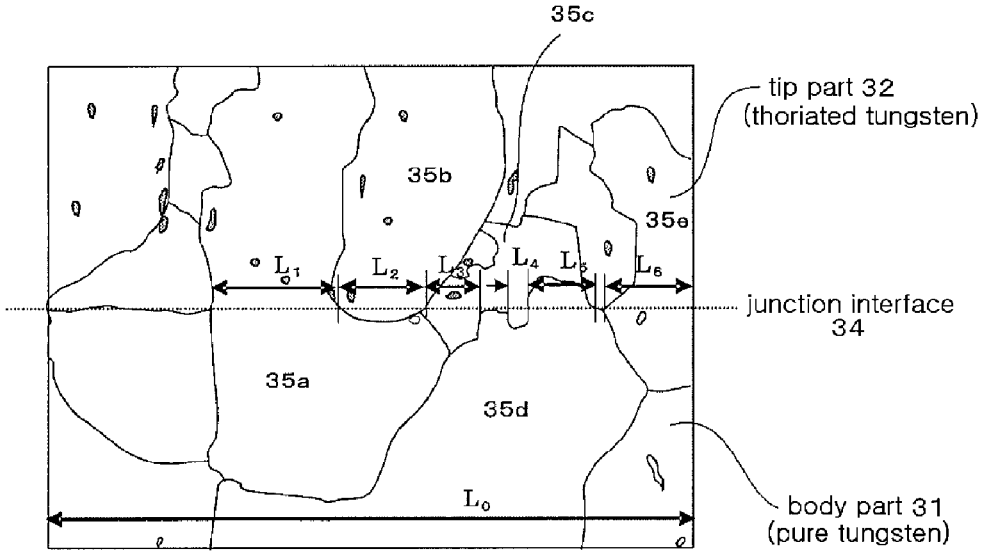
FIG. 5 is an enlarged sectional view illustrating the cathode electrode that is in the bonded state according to the present invention.

FIG. 5 shows a sectional view of the junction of the cathode electrode that is formed by solid-phase diffusion bonding. For the sake of understanding, the body part 31 and the tip part 32 prior to being bonded to each other are illustrated as sectional views in FIGS. 4A and 4B.

A junction surface 31*a* of the body part 31 that is made of tungsten and a junction surface 32*a* of the tip part 32 that is made of thoriated tungsten are shaped into a planar shape by cutting or grinding.

Referring to FIGS. 4A and 4B illustrating the state before the bonding process, on the junction surfaces 31*a* and 32*a*, planar surfaces of tungsten crystal grains 33 of the body part 31 and the tip part 32 are exposed to the outside.

As shown in FIG. 3, these junction surfaces 31*a* and 32*a* are put into contact with each other and are solid phase bonded to each other by applying heat and pressure thereto.

As shown in FIG. 5, on a junction interface 34 between the body part 31 and the tip part 32 that have been solid-phase bonded to each other, several crystal grains grow towards each other through the junction interface 34 and then are bonded to each other.

In the junction interface 34 between the body part 31 and the tip part 32 that have been bonded to each other, compared to the case where interfaces of crystal grains are put into surface contact with each other and are bonded to each other, the crystal grains that have grown through the junction interface 34 and been bonded to each other can increase bonding force on the junction interface 34, thus markedly enhancing the fracture resistance performance.

Understanding the presence of the crystal grains that have grown through the junction interface 34, the inventor of the present invention manufactured a variety of samples and measured the tensile strengths of the samples. After the tensile strengths of the samples were evaluated, a proportion of the tungsten crystal grains, which are present through the junction interface 34, to the junction interface 34 was defined In detail, in a section of the cathode electrode 3 taken along a line perpendicular to the junction interface 34 between the body part 31 and the tip part 32, an arbitrary portion of 500 μm or more in length along the junction interface 34 is defined. When the length of the arbitrary portion along the junction interface 34 is set to $L_0$ and the sum of the lengths of the tungsten crystal grains, along the junction interface 34, which are present through the junction interface 34 is set to L, $L/L_0$ (hereinafter, also referred to as a bonding rate) is determined. With regard to this, a variety of samples were manufactured, and the tensile strengths of the samples were tested.

Here, the samples were manufactured in such a way that the bonding process is conducted with changes in the heating temperature, the pressurized load and the heating duration.

In each sample that has been produced through the bonding process, as shown in FIG. 5, with regard to crystal grains 35*a*, 35*b*, 35*c*, 35*d* and 35*e* that are present through the junction interface 34, a ratio ($L/L_0$) of the total length L ($L_1+L_2+L_3+L_4+L_5+L_6$) of a length $L_1$ (the crystal grain 35*a*) along the junction interface 34, a length $L_2$ (the crystal grain 35*b*), a length $L_3$ (the crystal grain 35*c*), a length $L_4$ (the crystal grain 35*c*), a length $L_5$ (the crystal grain 35*d*) and a length $L_6$ (the crystal grain 35*e*) to the length $L_0$ of the arbitrary portion along the junction interface 34 was defined.

Furthermore, the reason why the length of the arbitrary portion along the junction interface 34 is 500 μm or more is because the arbitrary portion must sufficiently cover the size of at least one tungsten crystal grain so as to prevent a measurement error from occurring depending on a length of a measurement portion.

Figure 6A:
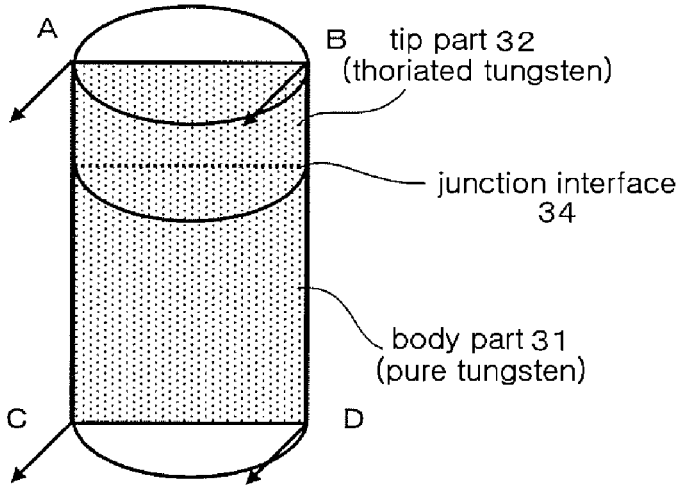
FIG. 6A is a schematic view of bonded members according to the present invention.
Figure 6B:
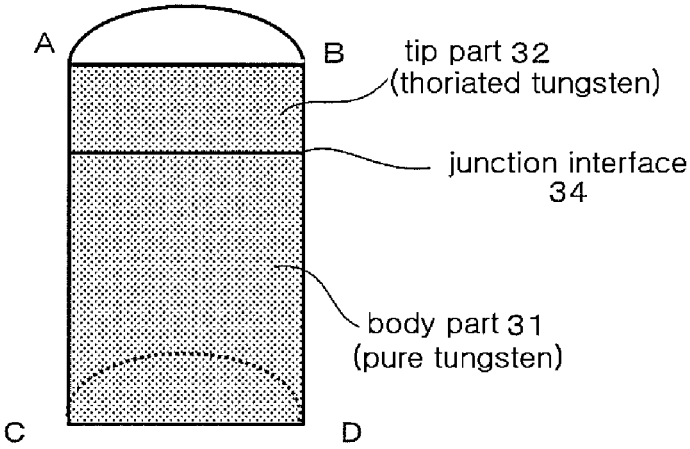
FIG. 6B is a sectional view of bonded members according to the present invention.

In this measurement process, as shown in FIGS. 6A and 6B, the sample is cut on a plane perpendicular to the junction interface. The cut surface of the sample is ground. Furthermore, the cut surface of the sample is processed by etching using a mixture solution of sodium hydroxide and potassium ferricyanide so as to accentuate crystal grains on the cut surface. After the etching process, an area around the junction interface was observed with a SEM.

Furthermore, around junction interface, tungsten and thorium oxide are distinguished on a SEM photograph, because electron emission efficiencies thereof differ from each other. Therefore, it can be determined which side is thoriated tungsten.

Test objects are provided under five bonding conditions (related to the temperature, load, and duration of power application). With regard to each condition, three samples were manufactured. A first sample was used to obtain the bonding rate $L/L_0$. A second sample was used to determine the tensile strength. A third sample was used to determine whether there was a breakage resulting from the cutting. Furthermore, the bonding rate was determined by calculating the average of bonding rates of a plurality of portions on the junction interface.

Figure 8:
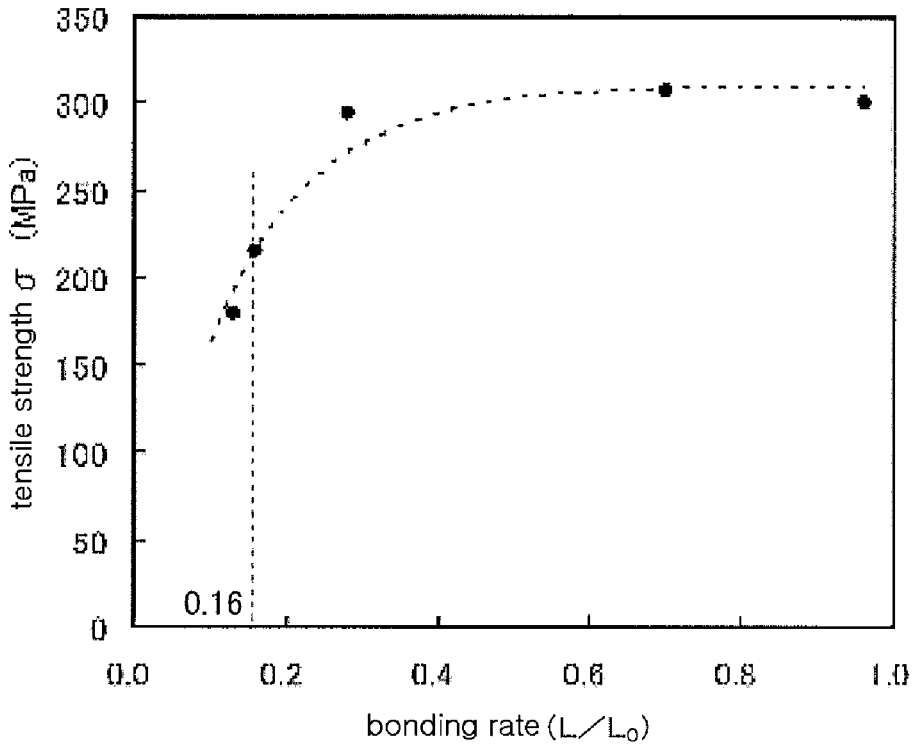
FIG. 8 is a graph showing the effects of the present invention.

The result of this is shown in the table of FIG. 7 and the graph of FIG. 8.

When the bonding rate $L/L_0$ was 0.13, in a tensile test, a breakage occurred on the junction interface, and in a cutting test, the bonded members were broken from the junction interface by impact generated when cutting. When the bonding rate was 0.16 or more, in a tensile test, a breakage occurred on a portion other than the junction interface and a tensile stress exceeded 200 MPa when the breakage occurred, and in a cutting test, there was no breakage.

From this, it was confirmed that, within a range of the bonding rate $L/L_0 \geq 0.16$, the mechanical strength of the bonded members was the same as that of the tungsten that is the parent metal.

In addition, the upper limit of the bonding rate is not set to a special value. Although the upper limit is 1 (100%) in theory, some of the crystal grains on the junction interface practically do not become crystal grains that are present through the junction interface. The upper limit which was obtained from repeated tests by the inventor was 0.96.

As described above, the present invention provides a cathode electrode formed by solid-phase bonding a tip part made of thoriated tungsten to a body part made of tungsten. In a section of the cathode electrode taken along a line perpendicular to a junction interface between the body part and the tip part, after an arbitrary portion of 500 μm or more in length along the junction interface is defined, when the length of the arbitrary portion along the junction interface is set to L0 and the sum of the lengths of tungsten crystal grains, along the junction interface, which are present through the junction interface is set to L, $L/L_0 \geq 0.16$ is satisfied. Thereby, the mechanical strength on the junction interface is sufficiently high. Furthermore, the tensile strength of the junction interface can be the same as that of tungsten that is the parent material of the body part of the cathode electrode. Moreover, even when cutting work is conducted after the bonding process has been completed, the junction interface can be prevented from being damaged.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A short arc discharge lamp, comprising: a light emitting tube; and a cathode electrode and an anode electrode disposed opposite to each other in the light emitting tube, the cathode electrode comprising a body part made of tungsten and a tip part made of thoriated tungsten, the body part and the tip part being solid-phase bonded to each other, wherein, on a section of the cathode electrode taken along a line perpendicular to a junction interface between the body part and the tip part, in an arbitrary portion of 500 μm or more in length along the junction interface, when a length of the arbitrary portion along the junction interface is set to $L_0$, and a sum of lengths of tungsten crystal grains, along the junction interface, that are present through the junction interface is set to L, $(L/L_0) \geq 0.16$ is satisfied.

* * * * *